US005265863A

United States Patent [19]

Becker

[11] Patent Number: 5,265,863

[45] Date of Patent: Nov. 30, 1993

[54] SYSTEM FOR SLOWING CONTINUOUSLY ARRIVING SHEETS BEFORE STACKING

[75] Inventor: Ingo Becker, Düsseldorf, Fed. Rep. of Germany

[73] Assignee: Jagenberg Aktiengesellschaft, Dusseldorf, Fed. Rep. of Germany

[21] Appl. No.: 985,675

[22] Filed: Dec. 4, 1992

[30] Foreign Application Priority Data

Dec. 4, 1991 [DE] Fed. Rep. of Germany ..... 4139888

[51] Int. Cl.[5] ..... B65H 29/68

[52] U.S. Cl. ..... 271/183; 271/203

[58] Field of Search ..... 271/182, 183, 197, 202, 271/203

[56] References Cited

U.S. PATENT DOCUMENTS 4,632,381 12/1986 Cuir ..... 271/203 X
4,995,850 2/1991 Totani ..... 271/182 X

FOREIGN PATENT DOCUMENTS 1245702 6/1961 Fed. Rep. of Germany .
1931208 6/1969 Fed. Rep. of Germany .
2330560 6/1973 Fed. Rep. of Germany .
2755160 6/1979 Fed. Rep. of Germany .
2755160 3/1980 Fed. Rep. of Germany .
G8907553.6 7/1989 Fed. Rep. of Germany .
G9007362.2 5/1991 Fed. Rep. of Germany .

*Primary Examiner*—Richard A. Schacher
*Attorney, Agent, or Firm*—Herbert Dubno; Andrew Wilford

[57] ABSTRACT

A succession of sheets are delivered by a main conveyor in a direction at high speed to a braking station and are thereafter piled up by a stacker. A braking apparatus at the station has an endless braking belt having a section of predetermined limited length formed with throughgoing belt holes and a section of substantially greater length that is substantially imperforate. A support holds the belt in the station with a stretch of the belt generally aligned with the direction and positioned to receive the sheets from the main conveyor. A suction box underneath the stretch has a face engaging the stretch, formed with throughgoing suction holes, and having a length in the direction shorter than the length of the imperforate section of the belt. A drive advances the belt such that the stretch moves in the direction at a periodically varying speed with the belt holes and suction holes only aligning periodically. Air is drawn in through the belt holes and suction holes only when same are aligned to draw the sheets down against the belt.

10 Claims, 9 Drawing Sheets

SYSTEM FOR SLOWING CONTINUOUSLY ARRIVING SHEETS BEFORE STACKING

FIELD OF THE INVENTION

The present invention relates to the production of stacks of sheets from a continuous web. More particularly this invention concerns a method of and apparatus for slowing the sheets as they arrive at high speed from a cutter before stacking the sheets.

BACKGROUND OF THE INVENTION

In the production of many products, for instance, writing paper, a web of the sheet material is pulled at high speed from a roll or other supply and is cut longitudinally and transversely into individual sheets that are moved at the high speed to a station where they are stacked. Before they are laid on the stack, the sheets must be braked or slowed considerably from the high speed at which they move upstream.

Systems for doing this are described in German patent document 1,245,702 published Jul. 27, 1967, 1,931,208 of H. Vits published Feb. 24, 1971, 2,330,560 of M. Kubo et al published Jan. 10, 1974, and 2,755,160 of J. Bodewein published Jun. 13, 1979, as well as in German utility models 89 07 553 and 90 07 362, and in PCT application PCT/EP90/02143 of G. Schaffner et al. All of these devices attempt to grip the sheets, typically at their trailing edges, in a braking station immediately upstream of the stacker so the sheets can form an overlapping pile that is fed at low speed to the stacker.

In all known systems the sheets are treated rather roughly so that they can become dog eared or marked. In addition the braking equipment often is a complex mechanical device with differentially moving parts that are prone to failure at best and very expensive at worst. Even when a so called suction box, that is a chamber that is continuously evacuated and that has an upper surface on which a braking belt runs, is used, paper jams are common in that the sheet following a sheet adhered suctionally to the braking belt is pulled down onto the braking belt.

OBJECTS OF THE INVENTION

It is therefore an object of the present invention to provide an improved system for braking sheets prior to stacking.

Another object is the provision of such an improved system for braking sheets prior to stacking which overcomes the above-given disadvantages, that is which accurately and surely brakes the sheets arriving at high speed, yet which is relatively simple.

A further object is to provide an improved method of handling sheets.

SUMMARY OF THE INVENTION

The instant invention is used in a system where a succession of sheets are delivered by a main conveyor in a direction at high speed to a braking station and are thereafter piled up by a stacker. A braking apparatus at the station has according to the invention an endless braking belt having a section of predetermined limited length formed with throughgoing belt holes and a section of substantially greater length that is substantially imperforate. A support holds the belt in the station with a stretch of the belt generally aligned with the direction and positioned to receive the sheets from the main conveyor. A suction box underneath the stretch has a face engaging the stretch, formed with throughgoing suction holes, and having a length in the direction shorter than the length of the imperforate section of the belt. A drive advances the belt such that the stretch moves in the direction at a periodically varying speed with the belt holes and suction holes only aligning periodically. Air is drawn in through the belt holes and suction holes only when same are aligned to draw the sheets down against the belt.

The method of this invention therefore comprises the steps of delivering the sheets one at a time edgewise to a braking station at a relatively high speed at a predetermined delivery rate (sheets/time) and advancing a braking belt in the station such that a stretch of the belt moves at a speed alternating between a high speed corresponding generally to the high delivery speed of the sheets and a relatively low speed at a speed-alternation rate. The speed-alternation rate is synchronized to correspond to the delivery rate of the sheets so that the belt speed changes from high to low each time a sheet is delivered to the station. According to the invention air is aspirated in through only a portion of the belt stretch as it moves downstream to draw a sheet down into contact with the belt stretch as it is moving at the high speed and then slow down the belt stretch and the sheet drawn down on it to the low speed while not aspirating air through the belt stretch upstream of the belt portion so that the following sheet is not drawn down onto the belt stretch. Then the sheets are delivered from the braking belt at the low speed to a stacker. Belt movement and sheet delivery are synchronized such that the belt portion through which air is aspirated always falls under the trailing end of a sheet.

With this system, therefore, the trailing end of each sheet only is grabbed by the braking belt to slow down the sheet, while the next sheet can slide over this trailing end and over the belt upstream in the imperforate region upstream of the perforated region that the leading sheet is adhered to by suction. In the instant invention the region of the braking belt that actually is used to suck the sheet down into contact with the belt, so that the belt and sheet can be slowed, in fact moves in the transport direction with the sheet. This is in sharp distinction to the prior-art suction-box systems where the entire length of the suction box is effective at all times, that is where the suction region does not travel.

In accordance with this invention the brake belt is formed by a plurality of substantially identical and parallel brake belts. Each brake belt has at least two such sections formed with brake holes and alternating with respective such imperforate sections. Furthermore the main conveyor feeds the sheets to the braking apparatus along a horizontal plane and the braking-belt stretch is inclined downwardly in the direction from the plane.

According to further features of the invention nozzles directed upward across the plane immediately upstream of the braking apparatus ensure that each following sheet slides over top of the sheet leading it.

The drive of this system can be a variable-speed motor. It can also be a fixed-speed motor having a speed-smoothing fly-wheel and connected to the braking belt through a variable-speed transmission which can itself include a linkage or crank mechanism producing the desired harmonically varying advance speed for the brake belt.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
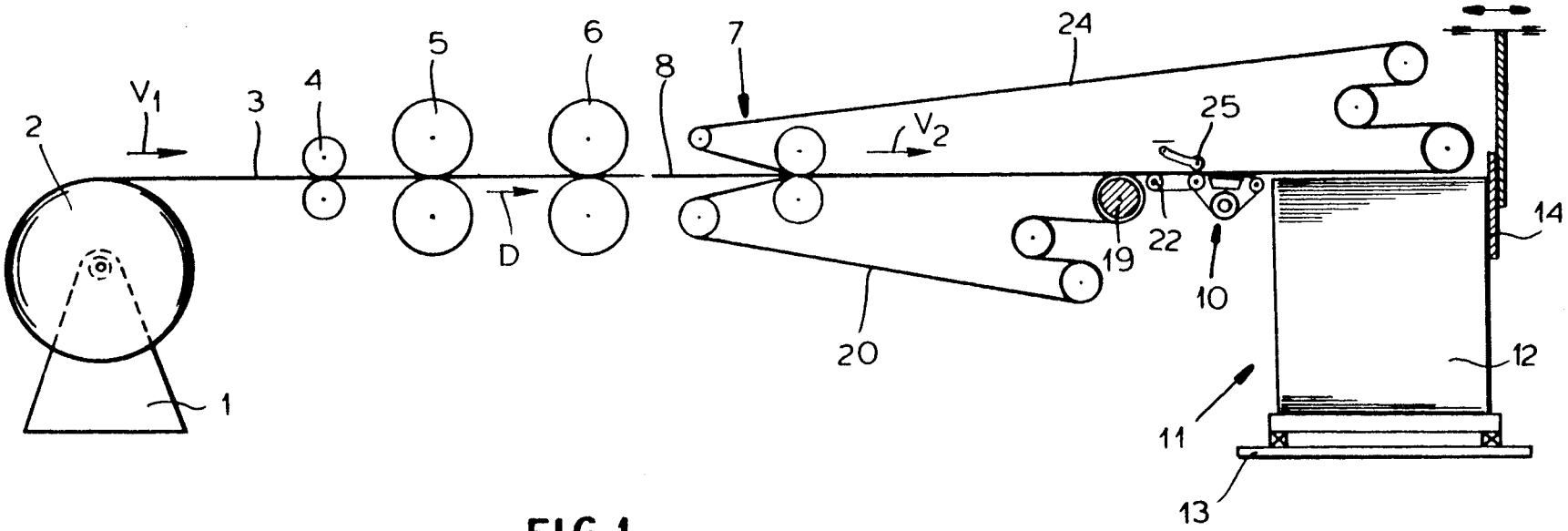
FIG. 1 is a small-scale mainly diagrammatic view illustrating the system of this invention.
Figure 2:
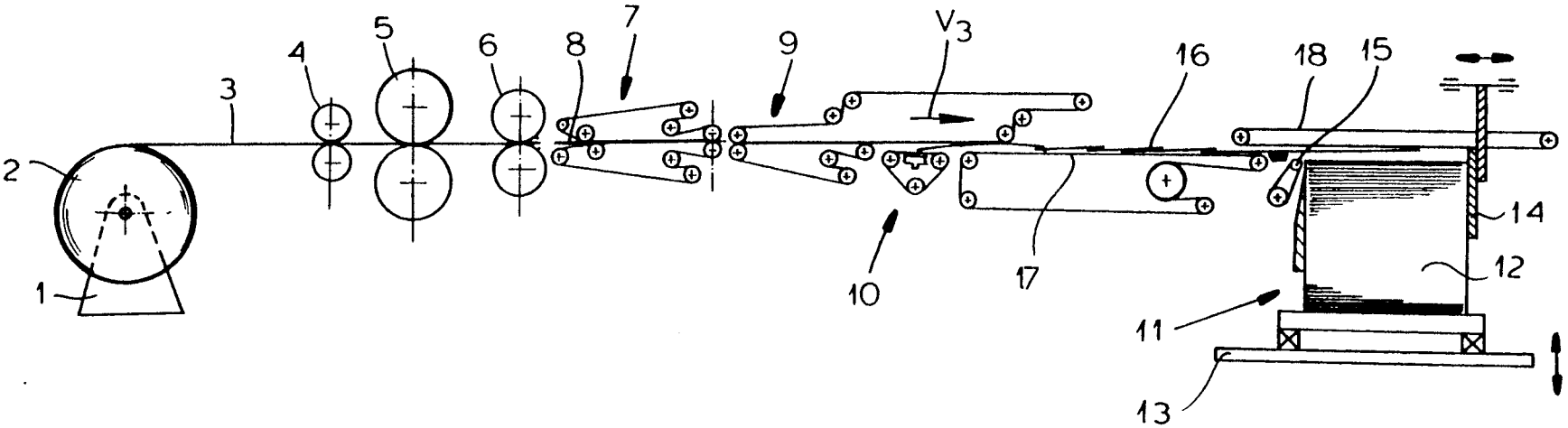
FIG. 2 is a view like FIG. 1 of an alternative system in accordance with this invention.

As seen in FIGS. 1 and 2 a continuous web 3 of paper or the like is pulled at a high speed $V_1$ by rollers from a supply 2 carried on a support 1. The web 3 is first slit longitudinally by a device 4 and then cut transversely by a cutter 6 into individual sheets 8 that are fed at the high speed $V_1$ to the upstream end of a conveyor 7 formed by lower belts 20 and upper belts 25 all moving in a transport direction D at a speed $V_2$ that is normally even faster than the speed $V_1$ so as to longitudinally separate the sheets 8 in the transport direction D.

The individual sheets 8 are slowed and overlapped by a braking device 10 and then fed into a stacker 10 forming a stack 12 and having a base 13 and a back wall 14. The sheets 8 hit the back wall 14 edgewise at low speed and then settle down to form a neat stack 12.

In the embodiment of FIG. 2 a second conveyor 9 takes the sheets from the conveyor 7 and accelerates them to a higher speed $V_3$. In addition the stacker 11 comprises intake belts 17 that move a stack 16 of the sheets between lower and upper belts 15 and 18 prior to dropping them in the container 12.

Figure 3:
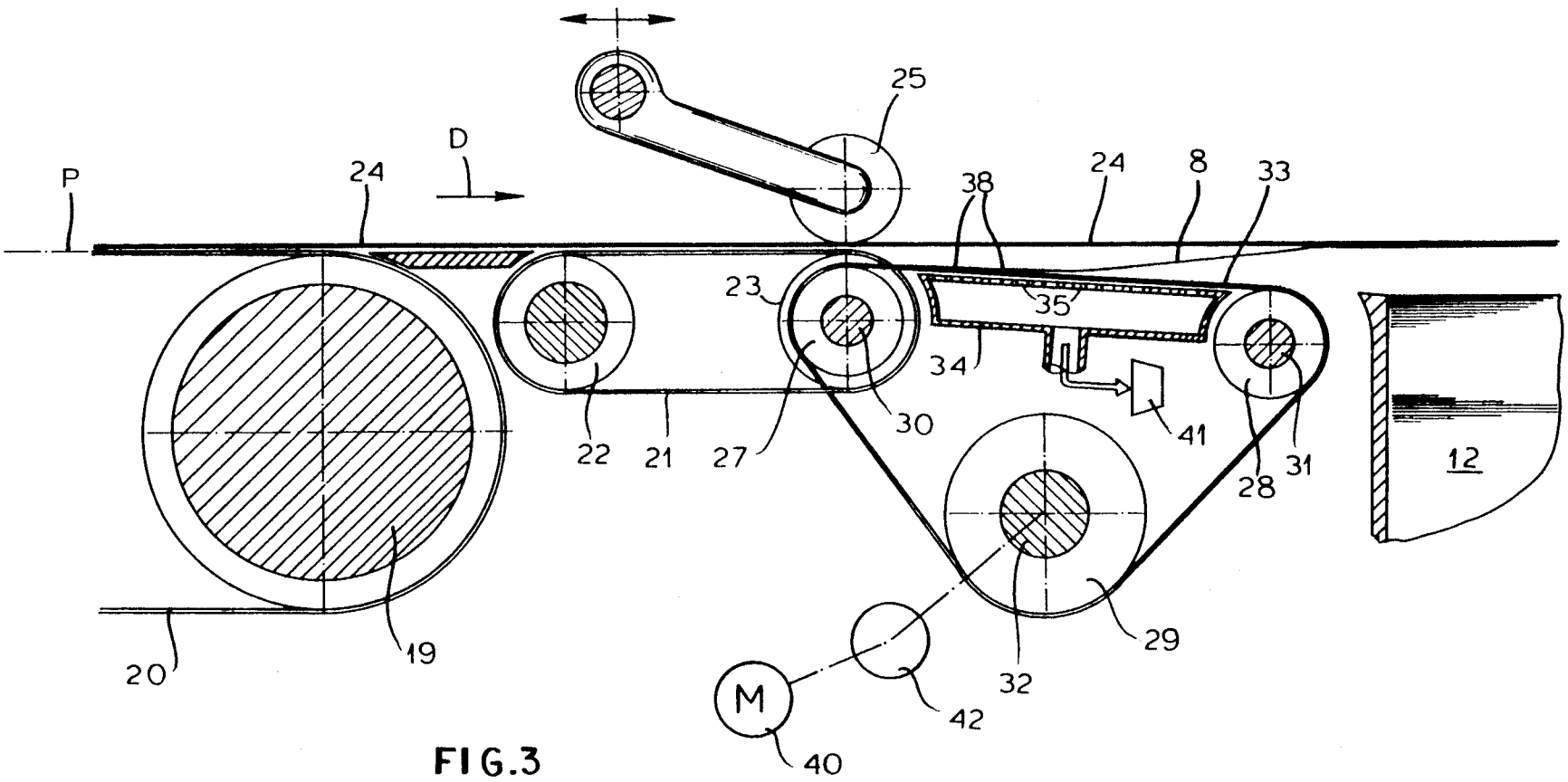
FIG. 3 is a larger-scale view of the braking unit of the invention.

As best seen in FIG. 3 the sheets 8 are fed from the belts 20 and 24 of the main conveyor 7 to the braking device 10 through a gripper arranged immediately downstream of the roller 19 of the lower belts 20 and comprising lower belts 21 spanned over wheels 21 and 22 and an upper pushdown roller 25. Thus as the sheets 8 pass from the main conveyor 7 to the braking device 8 they are solidly held and will not twist and get skewed.

The braking device itself comprises identical belts 26 spanned over three sets of wheels 27, 28, and 29 on respective shafts 30, 31, and 32 so as to form an upper stretch 33 that lies slightly below a transport plane P defined by the conveyor 7, and inclined slightly downward in the travel direction D The shaft 30 supports the wheels 23 for the upstream belts 21 also, although separate shafts could be used. A drive 40 which may be a variable speed motor or a fixed-speed motor and variable-speed transmission 42 is connected to the shaft 32 to advance the stretch 33 in the direction D at a speed that varies periodically between the speed at which the sheets 8 are delivered to it and a much slower speed at which the sheets 8 ar in turn delivered to the stacker 11.

Figure 4:
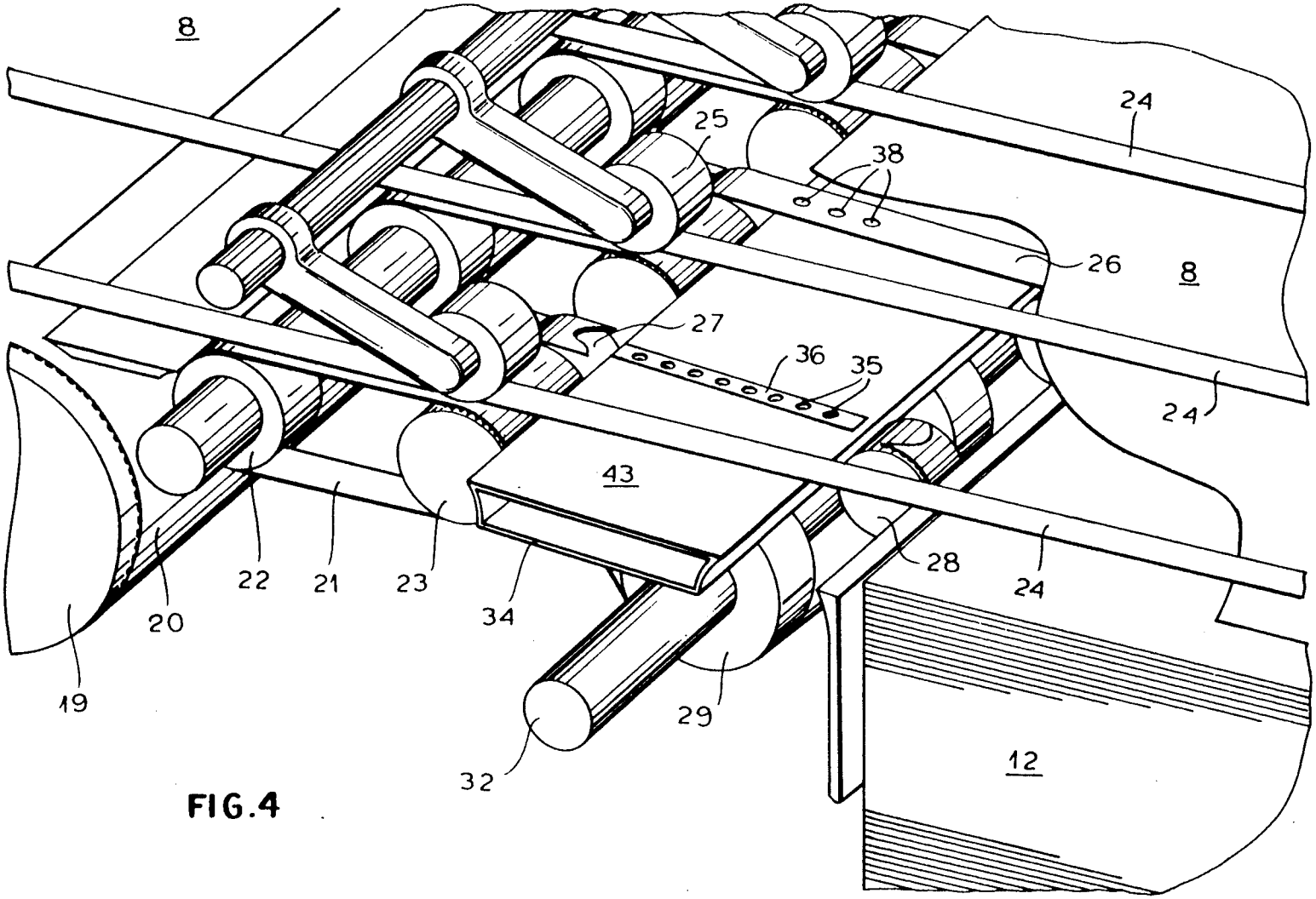
FIG. 4 is a perspective view of the braking unit, with some parts cut away to expose other parts.
Figure 5:
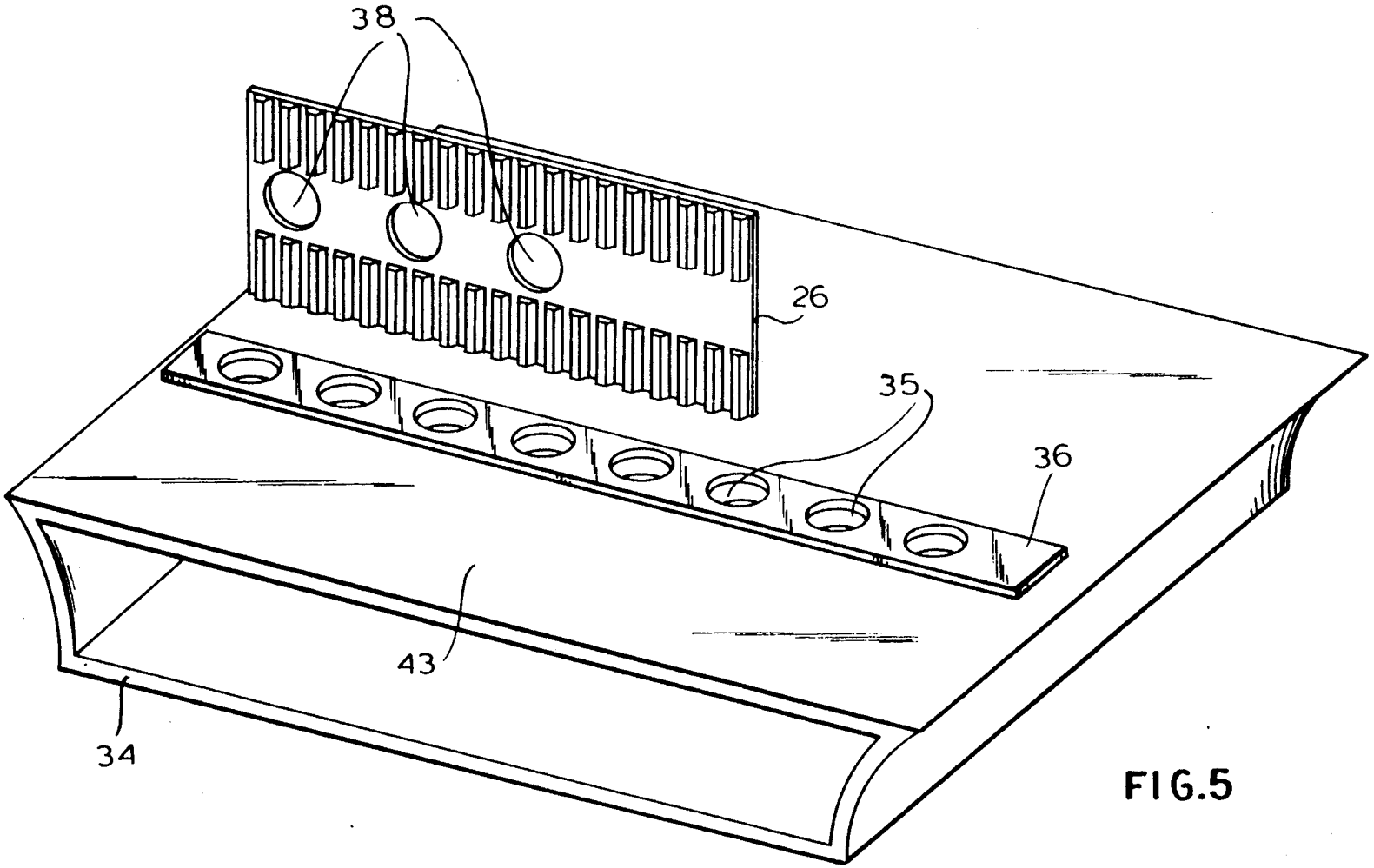
FIG. 5 is a detail view of elements of the invention.

Underneath the stretch 33 of the belts 26 is a suction box 34 formed at each of the belts 26 with a row of holes 35, the row having a length equal to substantially less than the minimum length of one of the sheets 8. This suction box 34 is connected to the intake of a blower 41 so that the holes 35 suck in air. In addition as also seen in FIGS. 4 and 5, the box 35 has a top face 43 provided with a plurality of parallel ridges or rails 36 (only one shown) at the holes 35, and the belts 25 are each formed with a central smooth area where the holes 38 are and two flanking toothed regions 37 that mesh with the wheels 29 on the shaft 32. The outer faces of the belts 26 are smooth. The holes 38 in the belts only extend along a section of limited length, one that is much shorter than the intervening imperforate section that itself is much longer than the rows of holes 35. The wheels 27 and 28 are spaced such that the stretch 33 has a length equal to between 30 mm and the maximum sheet length, between 50 mm and 500 mm. In addition the belts 26 may be formed with several such rows of holes 38 separated by longer imperforate sections.

Figure 6:
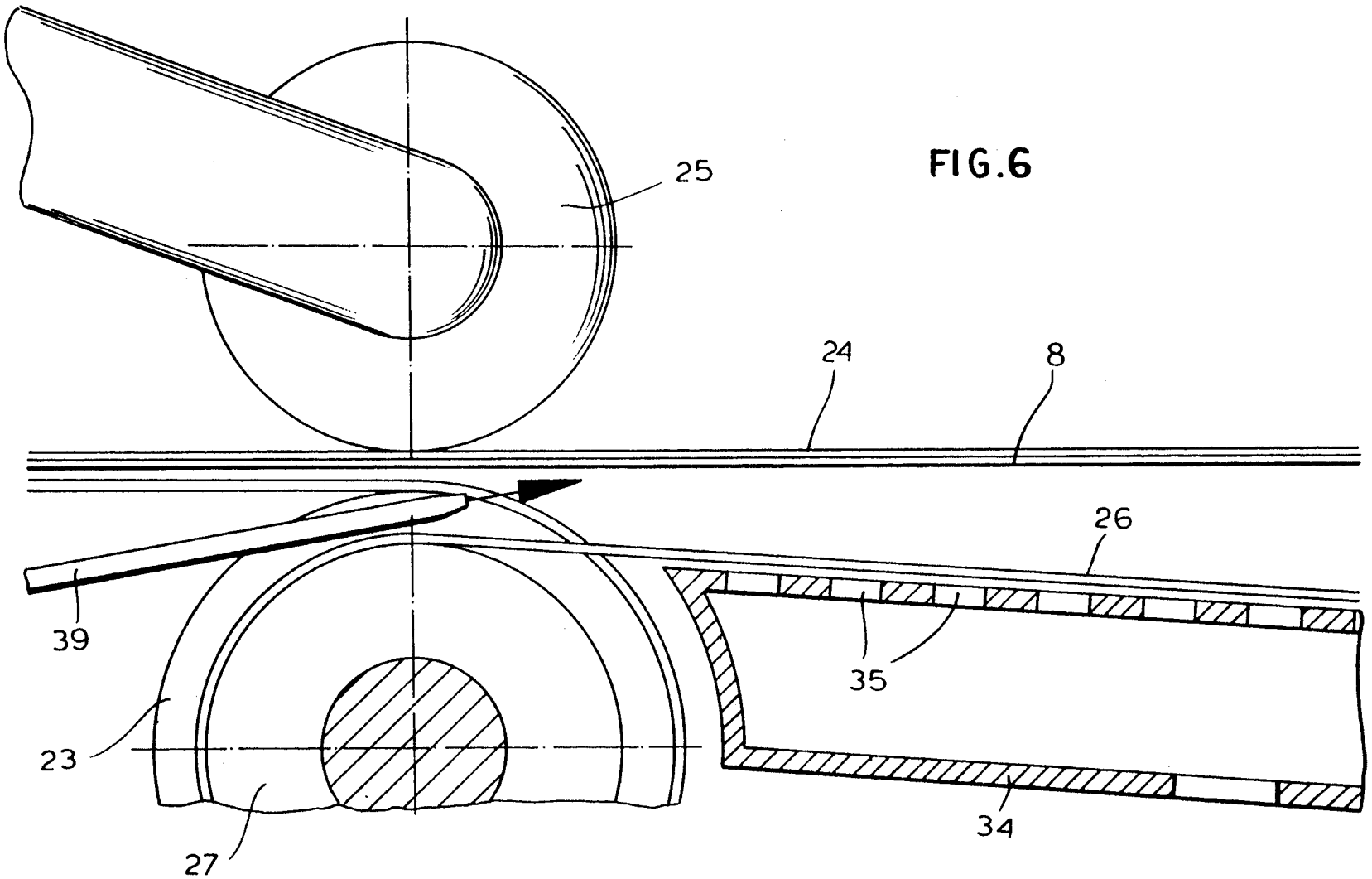
FIG. 6 is a large-scale view of a detail of FIG. 3.

As shown in FIG. 6 blower nozzles 39 are directed slightly upward across the path of the sheets 8 immediately upstream of the braking device 10 to press the leading ends of the sheets 8 up against the upper belts 24, thereby allowing the leading end of the following sheet 8, which is moving more rapidly than the sheet 8 ahead of it, to move over and lie atop this preceding sheet 8.

Figure 7:
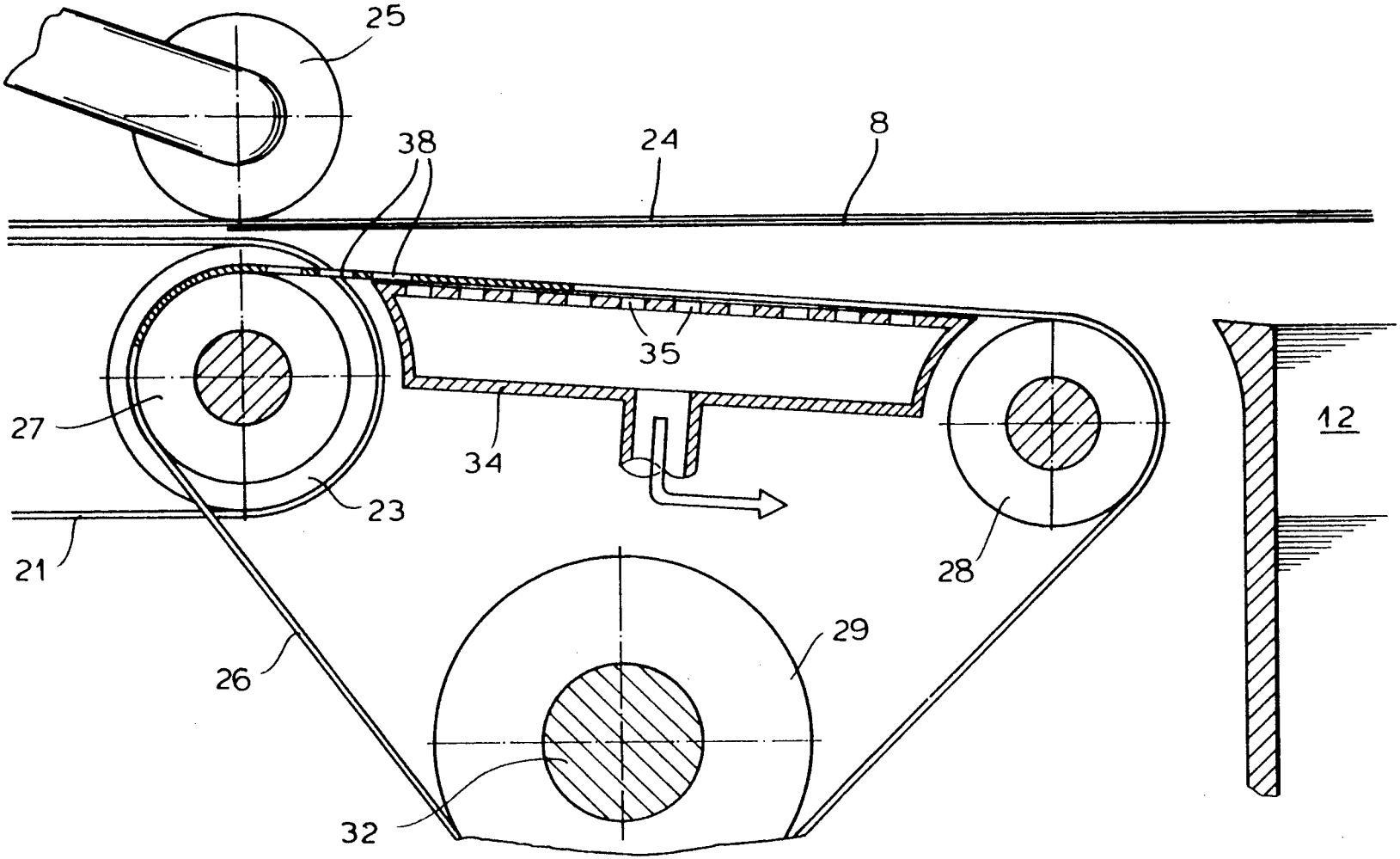
FIGS. 7, 8, and 9 are views like FIG. 3 illustrating successive steps of operation of the braking device.
Figure 8:
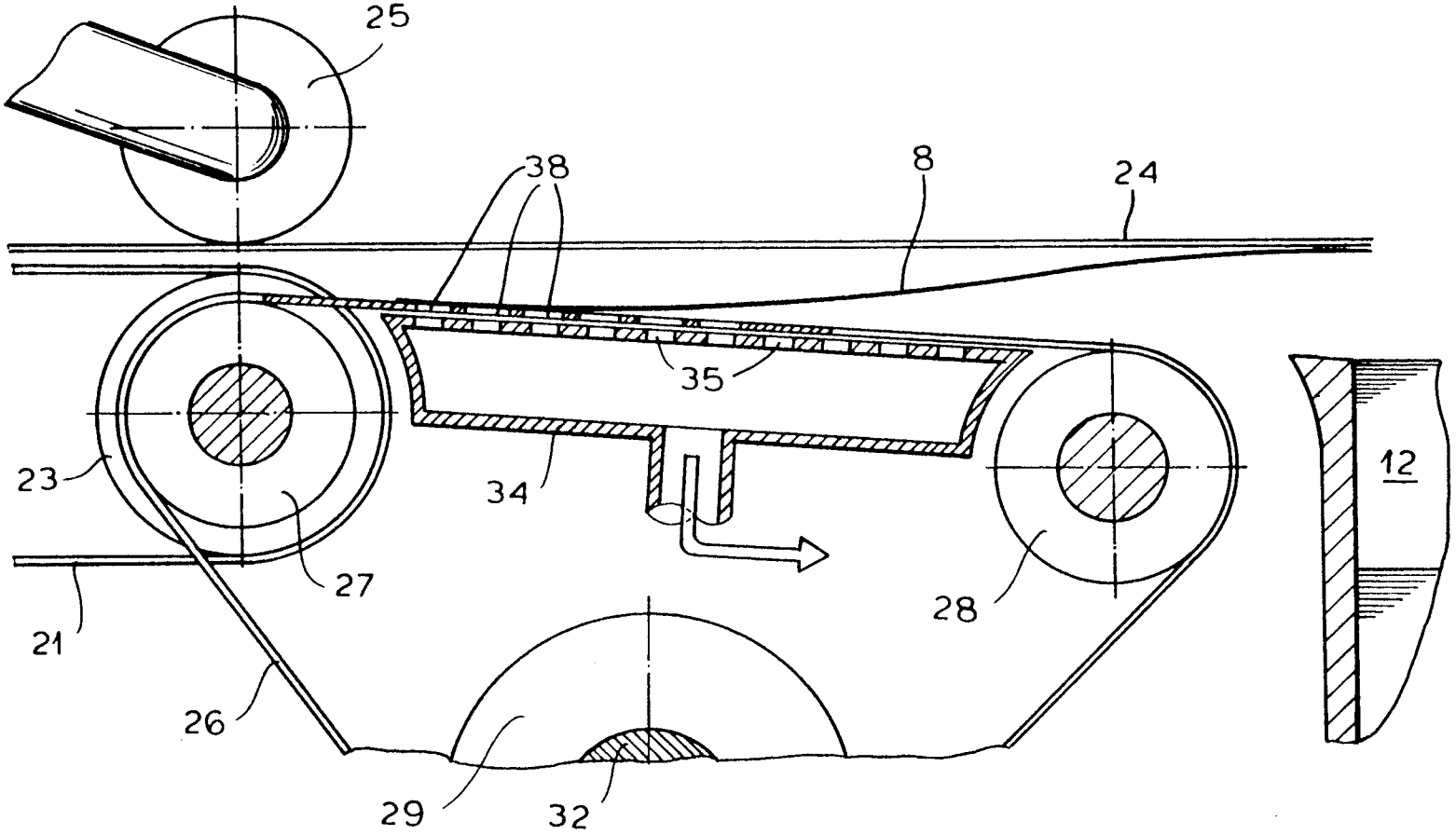
Figure 9:
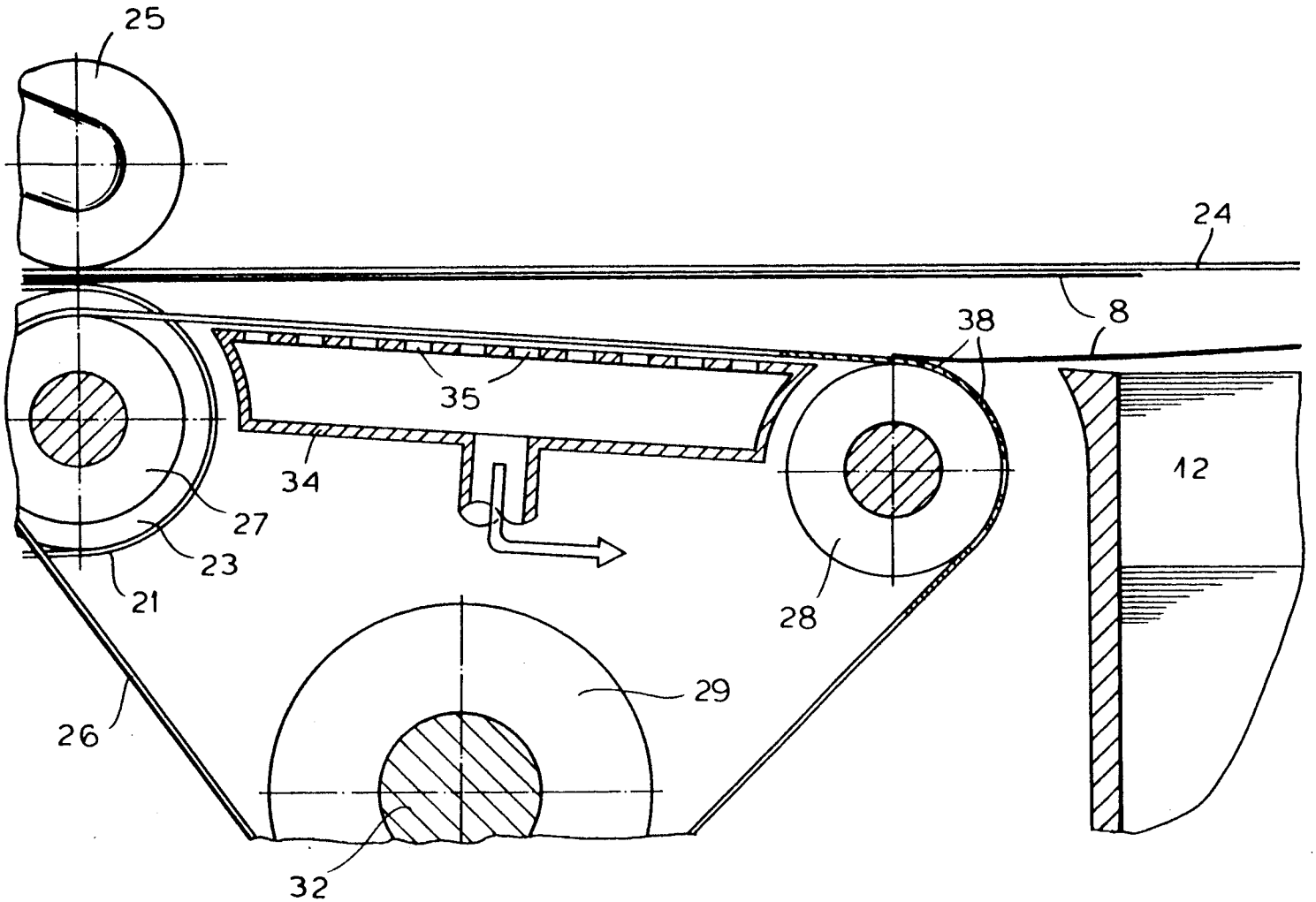

This system operates as follows, as shown in FIGS. 7 through 9:

When the trailing end of a sheet 8 moving at high speed reaches the suction box 34, the belts 26 are moving at the same high speed and the holes 38 are aligned with the holes 35 of the box 34, so that the trailing end is sucked down into tight contact with the belts 26. The drive 40 42 then slows down the belts 26 to a much slower speed thereby simultaneously slowing down the sheet 8 adhered by suction to the belts 26.

Meanwhile the holes 35 of the box 34 are being covered up by the imperforate sections of the belts 26 so that the leading edge of the next sheet 8 is not sucked down into contact with these belts 26, but instead slides forward over the sheet 8 stuck to the belts 26.

As the holes 38 move past the downstream end of the box 34, the sheet 8 held by them, which is by this time moving relatively slowly, is released and can feed into the stacker 11. Then the belts 26 are speeded up until the holes 38 come around to realign with the holes 35 and suck down the rear end of the next succeeding sheet 8, whereupon the cycle is repeated.

I claim:

1. In a system where a succession of sheets are delivered by a main conveyor in a direction at high speed to a braking station and are thereafter piled up by a stacker, a braking apparatus at the station comprising:

an endless braking belt having a section of predetermined limited length formed with throughgoing belt holes and a section of substantially greater length that is substantially imperforate;

support means holding the belt in the station with a stretch of the belt generally aligned with the direction and positioned to receive the sheets from the main conveyor;

a suction box underneath the stretch and having a face engaging the stretch, formed with throughgoing suction holes, and having a length in the direction shorter than the length of the imperforate section of the belt;

drive means for advancing the belt such that the stretch moves in the direction at a periodically varying speed with the belt holes and suction holes only aligning periodically; and means connected to the suction box for drawing in air through the belt holes and suction holes only when same are aligned and thereby drawing the sheets down against the belt.

2. The system defined in claim 1 wherein the brake belt is formed by a plurality of substantially identical and parallel brake belts.

3. The system defined in claim 1 wherein each brake belt has at least two such sections formed with brake holes an alternating with respective such imperforate sections.

4. The system defined in claim 1 wherein the main conveyor feeds the sheets to the braking apparatus along a horizontal plane and the braking-belt stretch is inclined downwardly in the direction from the plane.

5. The system defined in claim 4, further comprising nozzles directed upward across the plane immediately upstream of the braking apparatus.

6. The system defined in claim 1 wherein the drive means is a variable-speed motor.

7. The system defined in claim 1 wherein the drive means is a fixed-speed motor connected to the braking belt through a variable-speed transmission.

8. The system defined in claim 7 wherein the transmission includes a crank mechanism.

9. A method of handling sheets comprising the steps of:

delivering the sheets one at a time edgewise to a braking station at a relatively high speed at a predetermined delivery rate;

advancing a braking belt in the station such that a stretch of the belt moves at a speed alternating between a high speed corresponding generally to the delivery speed of the sheets and a relatively low speed at a speed-alternation rate;

synchronizing the speed-alternation rate to correspond to the delivery rate of the sheets, whereby the belt speed changes from high to low each time a sheet is delivered to the station;

aspirating air in through only a portion of the belt stretch as it moves downstream to draw a sheet down into contact with the belt stretch as it is moving at the high speed and then slow down the belt stretch and the sheet drawn down on it to the low speed while not aspirating air through the belt stretch upstream of the belt portion so that the following sheet is not drawn down onto the belt stretch; and delivering the sheets from the braking belt at the low speed to a stacker.

10. The sheet-handling method defined in claim 9, further comprising the step of synchronizing belt movement and sheet delivery such that the belt portion through which air is aspirated always falls under the trailing end of a sheet.

* * * * *